US005590867A

United States Patent [19]

Van Winkle

[11] Patent Number: 5,590,867

[45] Date of Patent: Jan. 7, 1997

[54] BLOWOUT PREVENTER FOR COILED TUBING

[75] Inventor: D. Wayne Van Winkle, Houston, Tex.

[73] Assignee: Drexel Oil Field Services, Inc., Conroe, Tex.

[21] Appl. No.: 440,525

[22] Filed: May 12, 1995

[51] Int. Cl.[6] ..... E21B 33/06

[52] U.S. Cl. ..... 251/1.3; 251/1.1

[58] Field of Search ..... 251/1.3, 1.1

[56] References Cited

U.S. PATENT DOCUMENTS 2,855,172 10/1958 Jones ..... 251/1.3
3,554,480 1/1971 Rowe ..... 251/1.3
4,646,825 3/1987 Van Winkle .
4,943,031 7/1990 Van Winkle .

*Primary Examiner*—John C. Fox
*Attorney, Agent, or Firm*—Gunn & Associates, P.C.

[57] ABSTRACT

The present invention provides a blowout preventer in which a first set of hydraulic ports communicate with either side of a first piston coupled to a first piston rod, a second set of hydraulic ports communicate with either side of a second piston coupled to a second piston rod, and the first and second pistons and associated piston rods may be actuated independent of each other. Each piston rod is coupled to a ram, and preferably, the first piston rod is coupled to a pipe ram and the second piston rod is coupled to a slip ram. A feature of the present invention provides that all of these elements are contained within a single chamber extending laterally of and communicating with the bore of a BOP.

3 Claims, 8 Drawing Sheets

BLOWOUT PREVENTER FOR COILED TUBING

FIELD OF THE INVENTION

The present invention relates generally to the field of blowout preventers (BOPs) and, more particularly, to a control device for a pair of rams which may be included within a multi-level blowout preventer stack that reduces the stack length and weight while providing independent control for each of the pair of rams.

BACKGROUND OF THE INVENTION

The use of blowout preventers in drilling, completion, workover, and production of oil and gas wells is well known. Such blowout preventers generally include a housing with a bore extending through the housing. Opposed chambers extend laterally of the bore in the housing and communicate with the bore. Rams are positioned in the chambers and the rams are connected to rods that are supported for moving the rams inwardly into the bore to close off the bore. This action divides the bore into a zone above the rams and a zone below the rams. The rods also serve to retract outwardly from the bore to open the bore.

Various types of rams may be employed such as those which engage circumferentially around a pipe or tubular member for sealing engagement with the tube or pipe, while others are provided with cutting surfaces for shearing tubular members or cables which extend through the bore of the blowout preventer.

Blowout preventers are also commonly used in coiled tubing systems. Such a BOP provides a means of holding the tubing and isolating the well bore pressure during a variety of conditions, including emergencies. The configuration of the BOP rams and sideport facility allows well-control operations to be conducted under a variety of conditions.

Newer blowout preventers include four sets of rams, which may be referred to herein as a "Quad BOP". The system comprises a set of four stacked elements, each with a different function. Blind rams are shut when there is no tubing or tool string extending through the body of the BOP. Shear rams are designed to close on and cut through the tubing. Slip rams close on and hold the tubing, ideally without damaging the surface of the piping or other tubular member. Finally, pipe rams seal around the tubing when it is place. Each of the rams should only be actuated when the tubing is stationary; otherwise, damage to either the BOP or the tubing is likely.

Stacking the four BOP elements one on top of the other has been found to unnecessarily extend the height of the Quad BOP. Further, the four elements are massive and consequently add a great deal of weight to the well head. In order to reduce the height and weight of the stack, certain Quad BOPs combine the primary actuators for each of the slip and the pipe ram. This has accomplished the intended purpose of reducing the height and weight of the stack but, unfortunately, eliminates the independent actuation of these elements.

Although slip rams ideally do not damage the tubing surface of the tubular member through the BOP, it has been found that even a single actuation of the slips against the tubing can score the exterior surface of the tubing. In today's high performance operations at elevated pressures, this scoring can reduce the useful lifetime of the tubular member, particularly with coiled tubing. Thus, there remains a need for the capability to actuate the pipe rams without actuating the slip rams, with the actuation elements included within a single ram body.

There remains a further need for a blowout preventer that is reduced in height and weight but which retains independently actuatable BOP rams. Such a blowout preventer should include the operations of two such ram elements, retaining their independent actuation, within a single ram body or chamber.

SUMMARY OF THE INVENTION

The present invention eliminates these and other shortcomings of the prior art. A first set of hydraulic ports communicate with either side of a first piston coupled to a first piston rod. A second set of hydraulic ports communicate with either side of a second piston coupled to a second piston rod and trie first and second pistons and associated piston rods may actuated independent of each other. Further, each piston rod is coupled to a ram. Preferably, the first piston rod is coupled to a pipe ram and the second piston rod is coupled to a slip ram. A feature of the present invention provides that all of these elements are contained within a single chamber extending laterally of and communicating with the bore of a BOP.

In a preferred embodiment, the first piston rod is a hollow cylinder and the second piston rod is positioned coaxially within the first piston rod. As the first piston is actuated to close the pipe ram, the second piston, along with its associated cylinder, travels along with the first piston rod, positioning the slip ram poised for setting. Then, independently, the slip ram may be set by actuation of the second piston, if desired.

Alternatively, the first and second piston rods may be positioned adjacent each other, rather than coaxially. Further, the hollow, cylindrical first piston rod may be sized to receive the second piston within the first piston rod.

These and other features and advantages of the present invention will be apparent to those of skill in the art from a review of the following detailed description along with the accompanying drawing figures.

DETAILED DESCRIPTION OF A PREFERRED EMBODIMENT

Structure of a Preferred Embodiment

Figure 1:
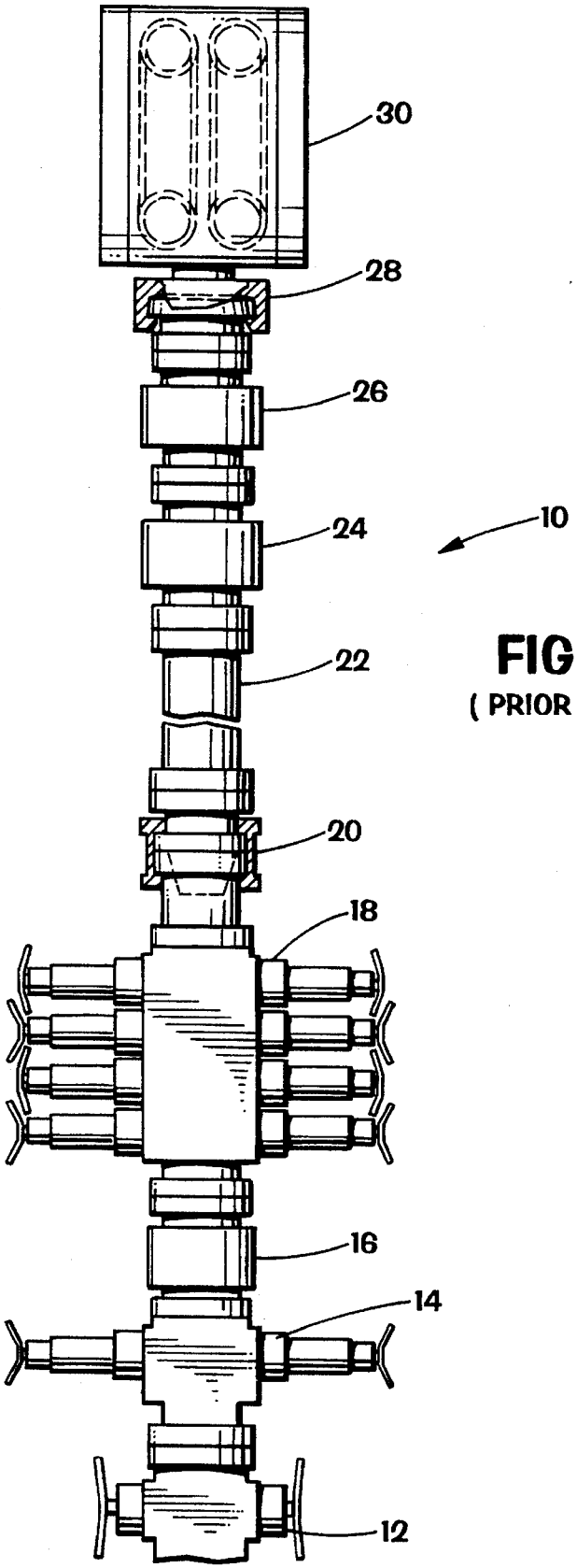
FIG. 1 ( PRIOR ART )
FIG. 1 is a side silhouette view of a prior art stack of elements that may included at a well head.

FIG. 1 depicts a typical stack 10 that is commonly used on a well head 12. Above the well head may be included, in bottom-to-top order, a blowout preventer 14, a flow Tee 16, a standard quad BOP 18, a HydraConn connector 20, a lubricator riser 22, a pair of striper/packers 24 and 26, an injector connector 28, and an injector 30 for the insertion of coiled tubing. Those of skill in the art will recognize that this is only intended to represent a typical stack, which is designed or modified to meet a specific application. Further, the various components selected to form the stack are typically joined together, such as by flanges for example, in a manner known in the art.

Figure 2:
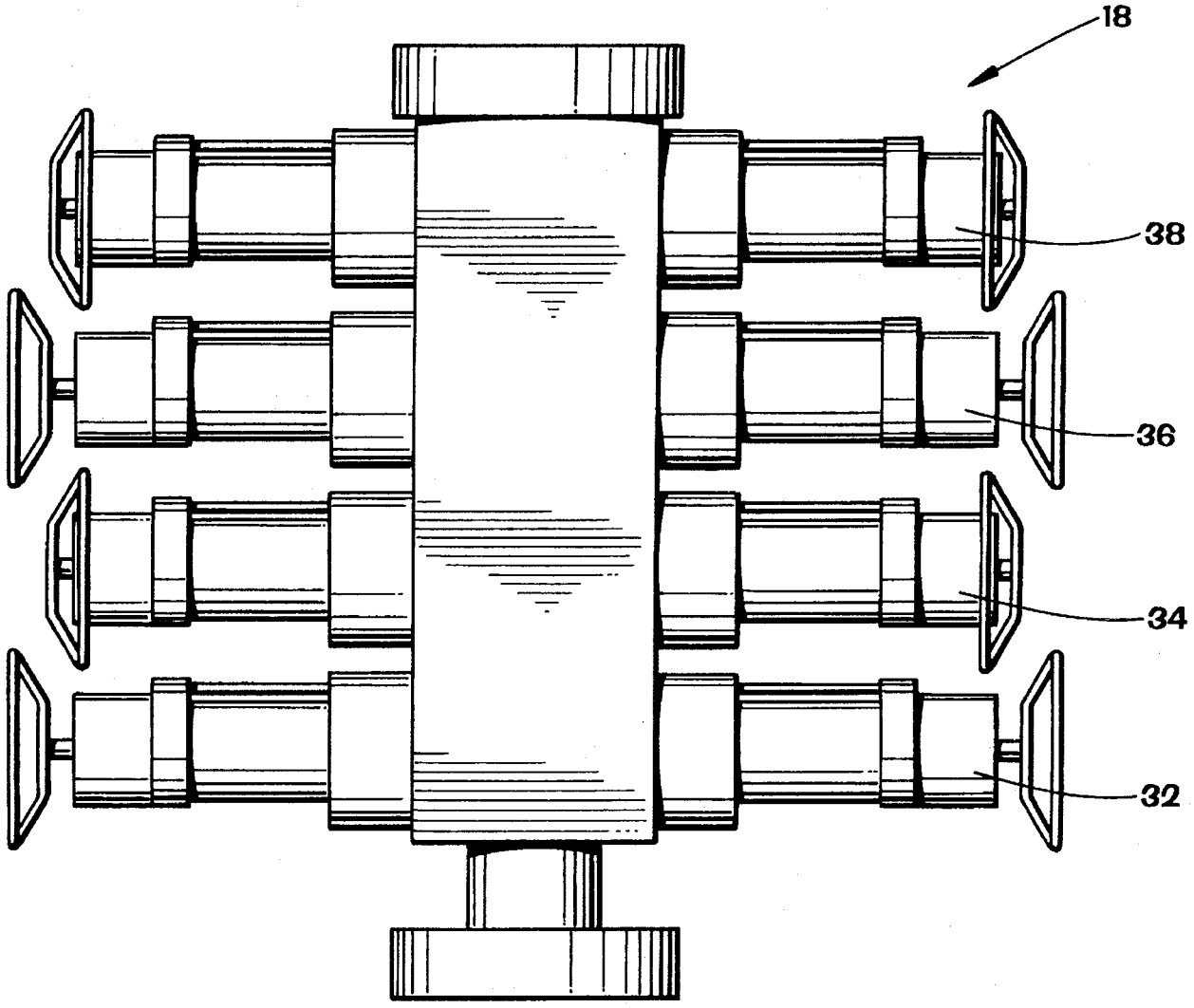
FIG. 2 ( PRIOR ART )
FIG. 2 is an elevation view of a prior art quad BOP.
Figure 3:
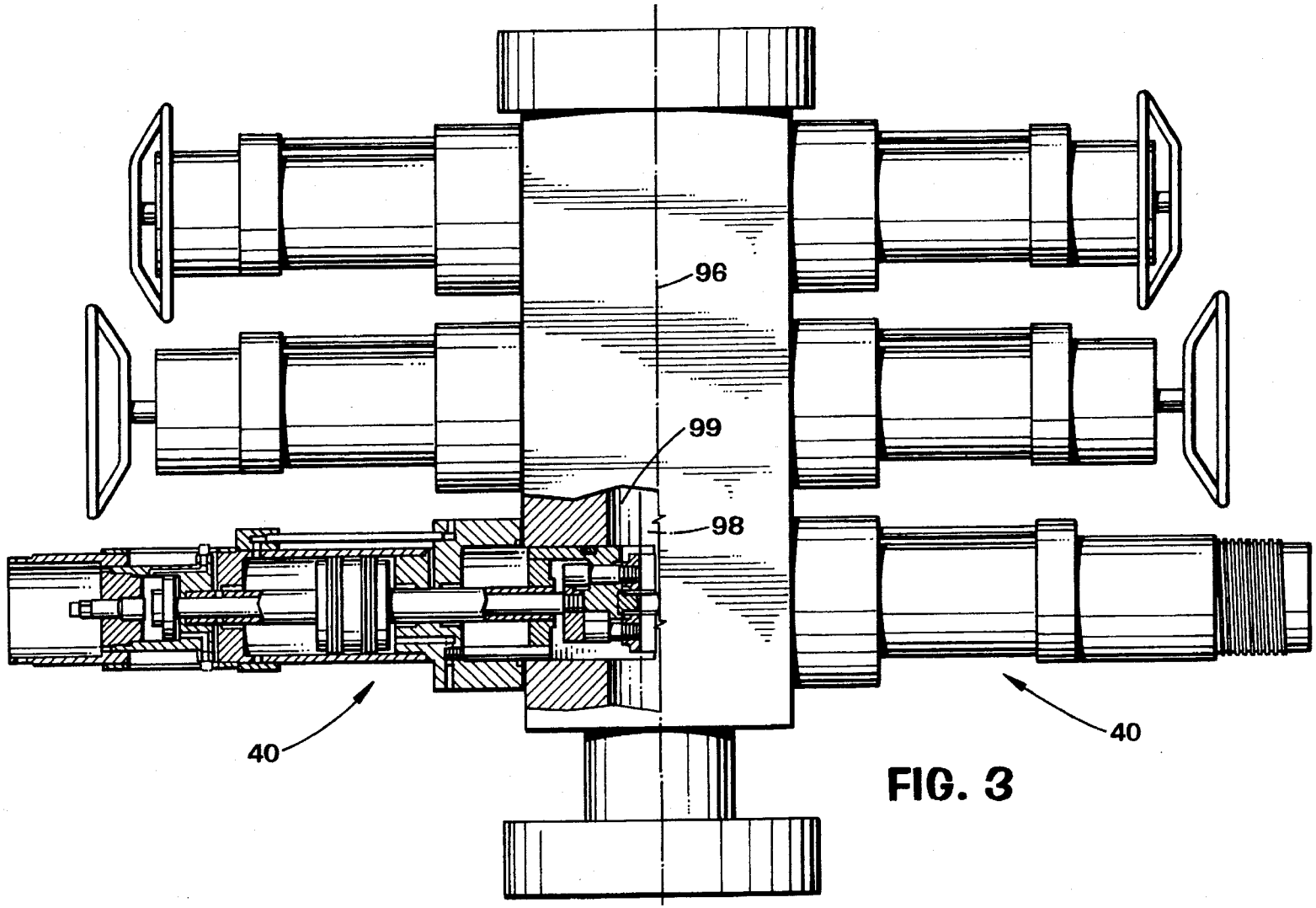
FIG. 3 is an elevation view of a quad BOP with the actuator or two of the rams within the BOP within a single housing in accordance with the present invention.
Figure 4:
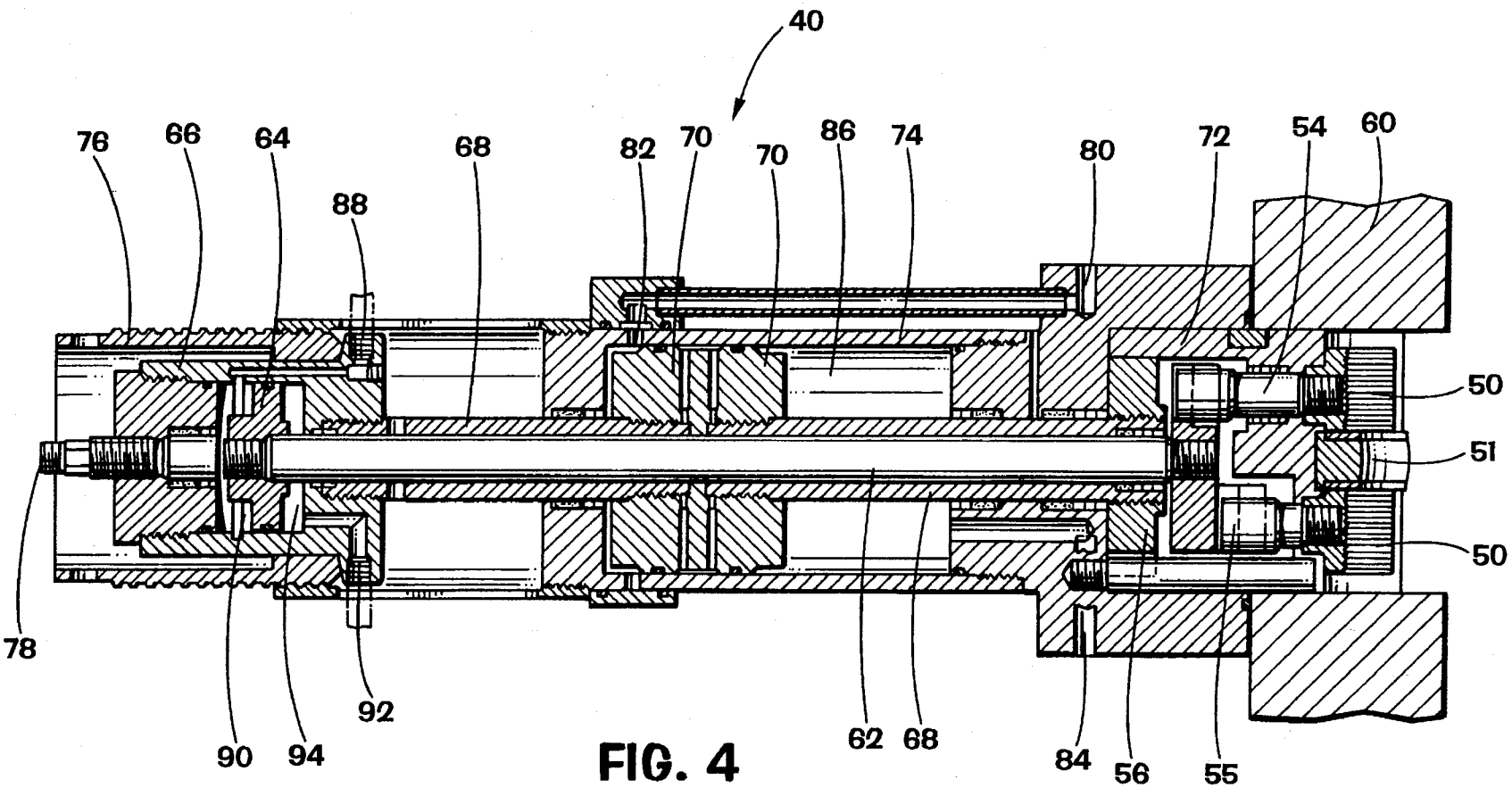
FIG. 4 is a side section view of the combination ram with segregated operator of the present invention.
Figure 5:
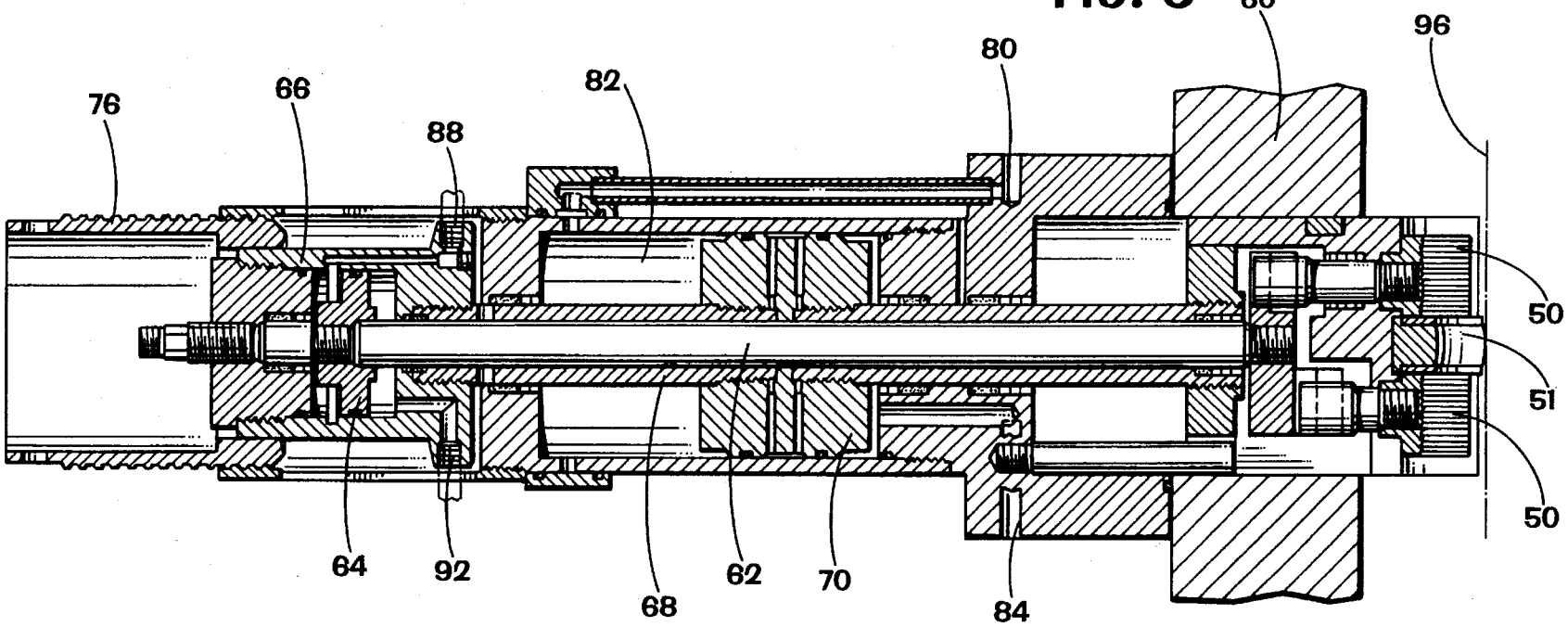
FIG. 5 is a side section view of the present invention with the pipe ram shut and slip rams still retracted.
Figure 5A:
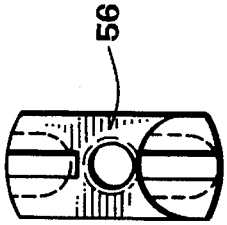

The quad BOP 18 includes the stacked rams previously described, and shown in FIG. 2. The quad BOP 18 includes a set of pipe rams 32, slip rams 34, shear rams 36, and blind rams 38. It is desirable to shorten the height of the BOP, and consequently its weight as well. This has been accomplished in the past by combining the pipe ram actuator with the slip ram actuator. Unfortunately, there are occasions when independent actuation of the slip rams from the pipe rams is desirable. FIGS. 3, 4, and 5 depict the details of the structure of the present invention to accomplished this desired result.

FIG. 3 depicts the desired installation of the combination pipe ram/slip ram 40 and associated structure. The structural details of the combination ram 40 will be described with regard to FIG. 4 and 5. As shown in FIG. 3, the combination ram 40 replaces the pipe rams 32 and slip rams 34 (FIG. 2). A pair of combination rams 40 are called for, each within a laterally opposed chamber in communication with a bore 99 of the BOP. This permits complete engagement with a tubular member or pipe 98, located coaxially with a centerline 96 of the BOP. Further, the present invention may also be used for combining two other rams as well, other than the pipe and slip rams.

Figure 7A:
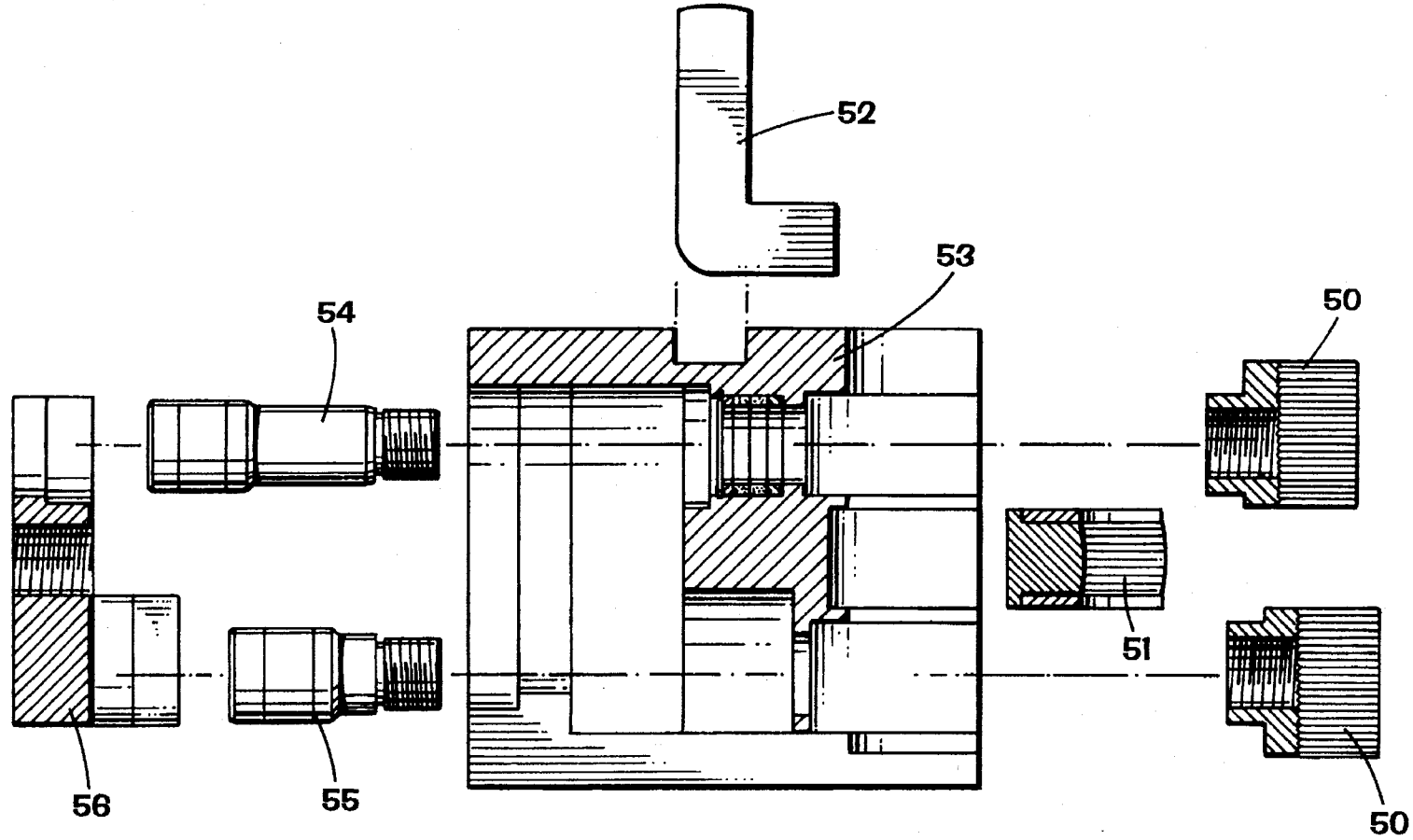
FIG. 7A is an exploded side view in partial section of the slips and the pipe rams.
Figure 7B:
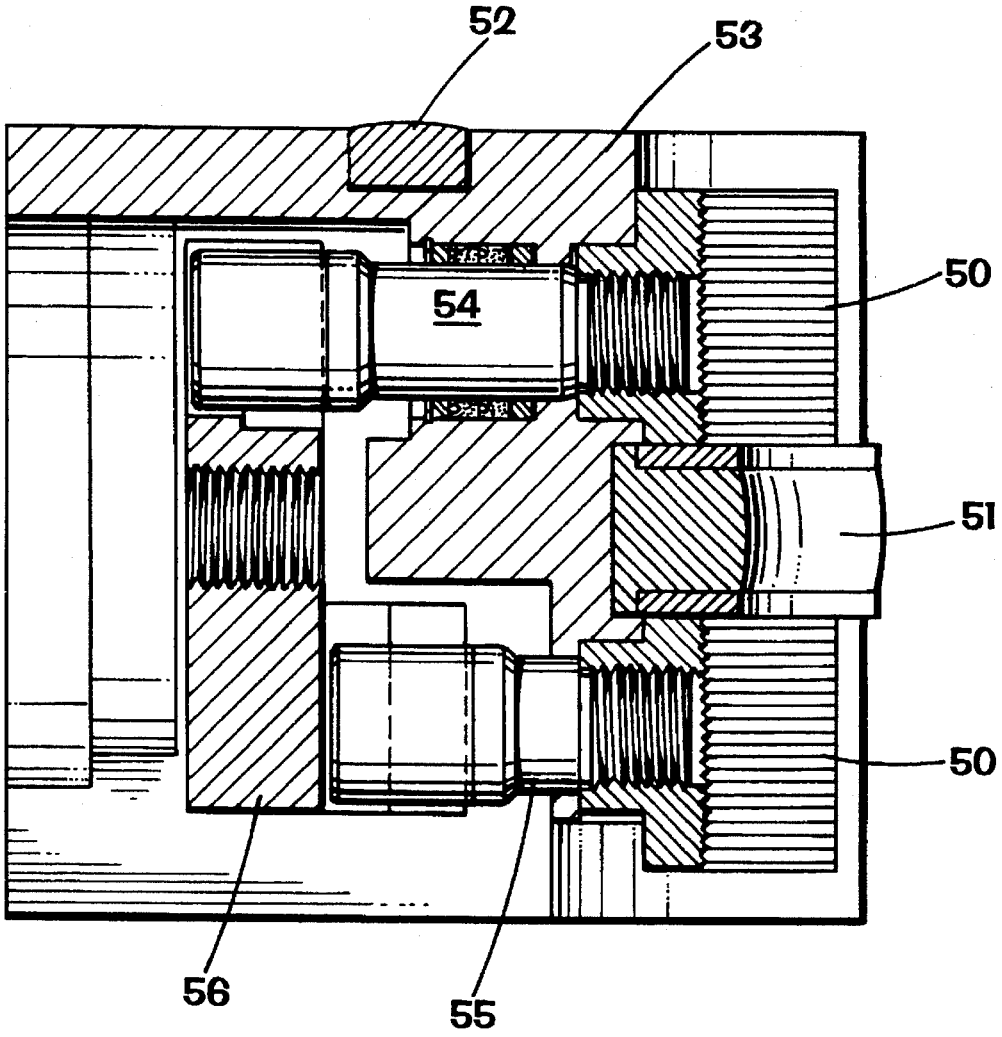
FIG. 7B is a side view of the elements of FIG. 7A in an assembled condition.

Referring briefly to FIGS. 7A and 7B, the currently preferred structure of the pipe rams and the slips is depicted. FIG. 7A is an exploded view in partial section, while FIG. 7B depicts the various parts in an assembled condition. The various parts include a set of slip inserts 50, a front seal 51, and a horseshoe seal 52. The top slip insert is threaded or otherwise appropriately coupled to a pusher 54 and the lower slip insert is coupled to a pusher 55, each within a ram body 53. The pushers 54 and 55 serve to push the slip inserts 50 forward. A guide 56 guides the assembly and moves the pushers 54 and 55. As shown in FIGS. 7A and 7B the pushers 54 and 55 are preferably of different lengths, but only for ease of assembly of the parts within the ram body 53. Those of skill in the art will appreciate that the assembly further includes various seals and retainers in a manner known in the art.

FIG. 4 provides a detailed section view of the structure of the combination ram 40. The combination ram 40 attaches to a section 60 of the BOP body. Within the combination ram is an inner coaxial rod 62 (not shown in section) that actuates the slips relative to the movement of the pipe ram body. The rod 62 is connected to a slip ram piston 64 within a cylinder 66. The cylinder 66 is attached to a main operator piston rod 68 and the rod 68 is threaded into a pipe ram piston 70. Although the piston rod 68 is preferably formed in two parts, both parts are shown in FIG. 4 designated as rod 68 for clarity since it functions as one piston rod. The rod 68 is keyed into the back side of a ram body 72 to move the ram back and forth within a cylinder 74.

The assembly further includes a manual locking assembly 76 to manually override hydraulic actuation of either or pipe rams. A manual locking assembly 78 prevents the slips from the retracting when the assembly 78 is actuated.

A set of hydraulic ports is also provided. A port 80 provides hydraulic pressure to close the pipe ram. The port 80 connects to a cylinder chamber 82 which, when pressurized, moves the piston 70 to the right (as seen in FIG. 4). The piston 70 is threaded onto the rod 68, which in turn is threadedly connected to the cylinder 66. Consequently, the slip actuation assembly also moves to the right. A port 84 is also provided which is coupled to a cylinder chamber 86 for opening the pipe ram.

A port 88 is connected to a cylinder chamber 90 to actuate the piston 64. Pressurization of the cylinder chamber 90 moves the piston 64 to the right. This motion abuts the inner rod 62 to close the slips. A port 92 is also provided to open the slips by pressurizing a cylinder chamber 94 and moving the piston 64 to the left.

Operation of the Preferred Embodiment

Now that the preferred structure of the present invention has been described in detail, the preferred method of operation will now be described. The condition of the combination ram 40 depicted in FIG. 4 shows the position of the movable elements with the pipe ram open port 84 and slip open port 92 having been pressurized. In other words, the piston 64 and the piston 70 are currently in their full, left-most position.

FIG. 5 show the position of various portions of the combination ram 40 with the pipe ram shut and the slips still retracted. The ellipses around the legends "PIPE RAMS CLOSE" and "SLIPS RELEASE" indicate that the ports 80 and 92 have been pressurized. It should also be understood at this point that the ports 84 and 88 serve as the discharge ports for hydraulic fluid during this evolution. The port 92 has been pressurized to ensure that, with the pipe ram closed, the slips remain retracted until affirmatively actuated.

With the port 80 pressurized, the cylinder chamber 82 is pressurized, forcing the piston 70 to the right until the front seal 51 contacts and seals around a pipe within the BOP, shown schematically in FIG. 5 as the centerline 96 of the bore 99 (see FIG. 3). The inner coaxial rod 62 and the main operator piston rod 68 have been moved together to the right as a unit. Note the relative positions of the manual actuator 76 and the cylinder 66 in FIGS. 4 and 5. However, with the port 92 pressurized, the piston 64 has not moved relative to the cylinder 66, and the slip inserts 50 have not contacted the pipe.

Figure 6:
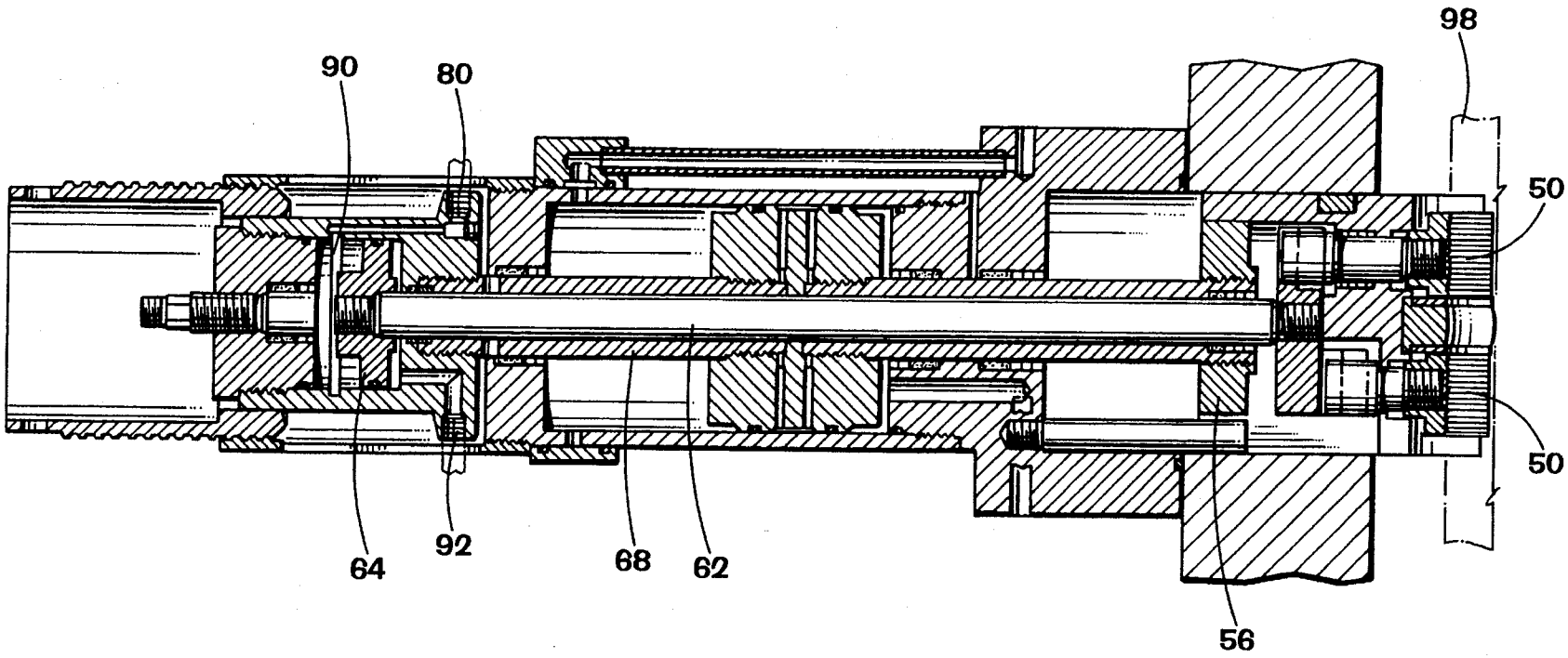
FIG. 6 is a side section view of the present invention with the pipe rams shut and the slips set.

Referring now to FIG. 6, at this point the slips have been closed. This is done by pressurizing the slips set port 88, thus pressurizing the cylinder chamber 90. This moves the piston 64 to the right. Since the inner coaxial rod 62 is coupled to the piston 64, the rod 62 also moves to the right, sliding within the main operator piston rod 68. This forces the guide 56 forward until the slip inserts 50 contact the pipe, shown in phantom in FIG. 6 as the pipe 98 (see FIG. 3).

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

For example, the preferred embodiment has been described as having coaxial actuation rods 62 and 68, with pistons 70 and 64 in tandem. Those of skill in the art will recognize that the rods 62 and 68 need not be coaxial, but could be placed side by side to carry out the present invention. Further, the main actuation rod 68 could easily be modified to include a slip actuation piston 64 within it, so that the pistons would not be in tandem. Other embodiments are certainly possible, fully within the scope of the present invention, so long as the rams are independently actuatable within one ram enclosure.

Furthermore, the present invention has been described with regard to pipe and slip rams. However, the present invention is equally applicable to blind and shear rams, or any pair of the four rams described, within the scope of the present invention. The present invention has also been described with regard to coiled tubing but is equally applicable to other types of pipe or tubing.

We claim:

1. A blowout preventer comprising:

a. housing with a bore extending through the housing;

b. a chamber extending laterally of the bore in the housing and communicating with the bore, the chamber defining an axis;

c. a pipe ram cylinder within the chamber;

d. a hydraulically actuated pipe ram piston within the pipe ram cylinder;

e. a hollow cylindrical pipe ram piston rod coupled to the pipe ram piston, the pipe ram piston rod coaxial with the axis of the chamber;

f. a front seal coupled to a first end of the pipe ram piston rod, the front seal capable of contacting a tubular member located within the bore;

g. a slip ram cylinder within the chamber, the slip ram cylinder positioned in tandem with the pipe ram cylinder;

h. a hydraulically actuated slip ram piston within the slip ram cylinder;

i. a slip ram piston rod coupled to the slip ram piston, the slip ram piston rod coaxial with the axis of the chamber and located within the pipe ram piston rod; and j. a slip insert coupled to a first end of the slip ram piston rod, the slip insert capable of contacting the tubular member located within the bore.

2. The blowout preventer of claim 1 wherein the blowout preventer comprises a portion of a multi-level blowout preventer.

3. The blowout preventer of claim 2 wherein the blowout preventer comprises a portion of a quad blowout preventer.

* * * * *